United States Patent [19]

Fogarollo

[11] 4,109,417

[45] Aug. 29, 1978

[54] GUIDE DEVICE FOR A SLIDABLE WINDOW OF A VEHICLE

[75] Inventor: Pier Paolo Fogarollo, Chiavari (Genoa), Italy

[73] Assignee: Lames Societa per Azioni, Chiavari (Genoa), Italy

[21] Appl. No.: 805,043

[22] Filed: Jun. 9, 1977

[30] Foreign Application Priority Data

Jun. 21, 1976 [IT] Italy ..... 68512 A/76

[51] Int. Cl.[2] ..... E05F 11/48

[52] U.S. Cl. ..... 49/352

[58] Field of Search ..... 49/352, 348, 349

[56] References Cited

U.S. PATENT DOCUMENTS 3,427,748 2/1960 Marr ..... 49/352

3,897,654 8/1975 Kouth et al. ..... 49/352

FOREIGN PATENT DOCUMENTS 1,292,950 10/1972 United Kingdom ..... 49/352

*Primary Examiner*—Kenneth Downey

*Attorney, Agent, or Firm*—Sughrue, Rothwell, Mion, Zinn & Macpeak

[57] ABSTRACT

A guide device for a sliding window in a vehicle has the usual central guide track for guiding the movement of a window support which is movable by means of a manual or powered winding mechanism, but to prevent rotation of the window about axes parallel to the surface of the window the guide track is tubular and has a longitudinal slot in which a cylindrical insert slides, the insert being connected through the slot to the movable window support.

4 Claims, 7 Drawing Figures

FIG. 1
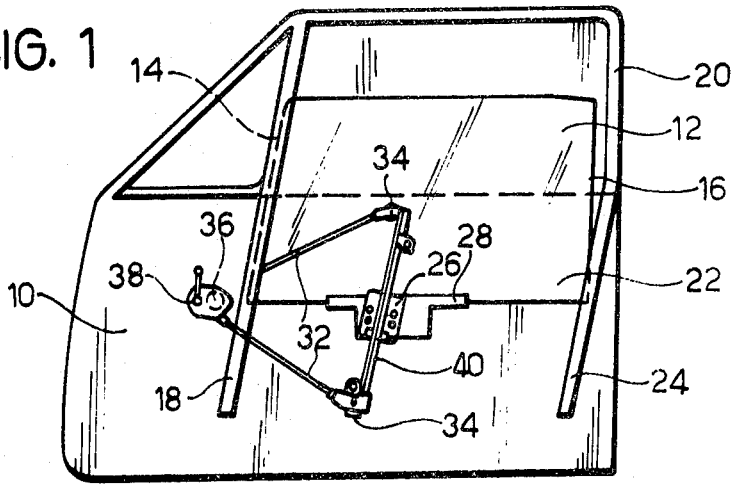
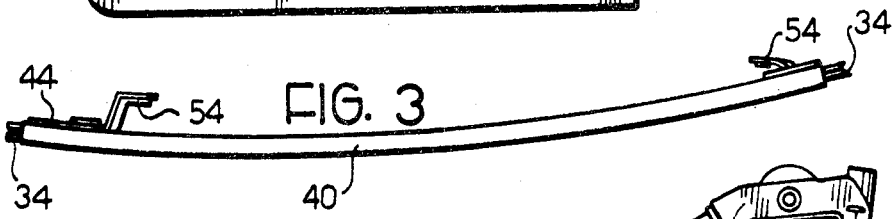
FIG. 3
FIG. 2
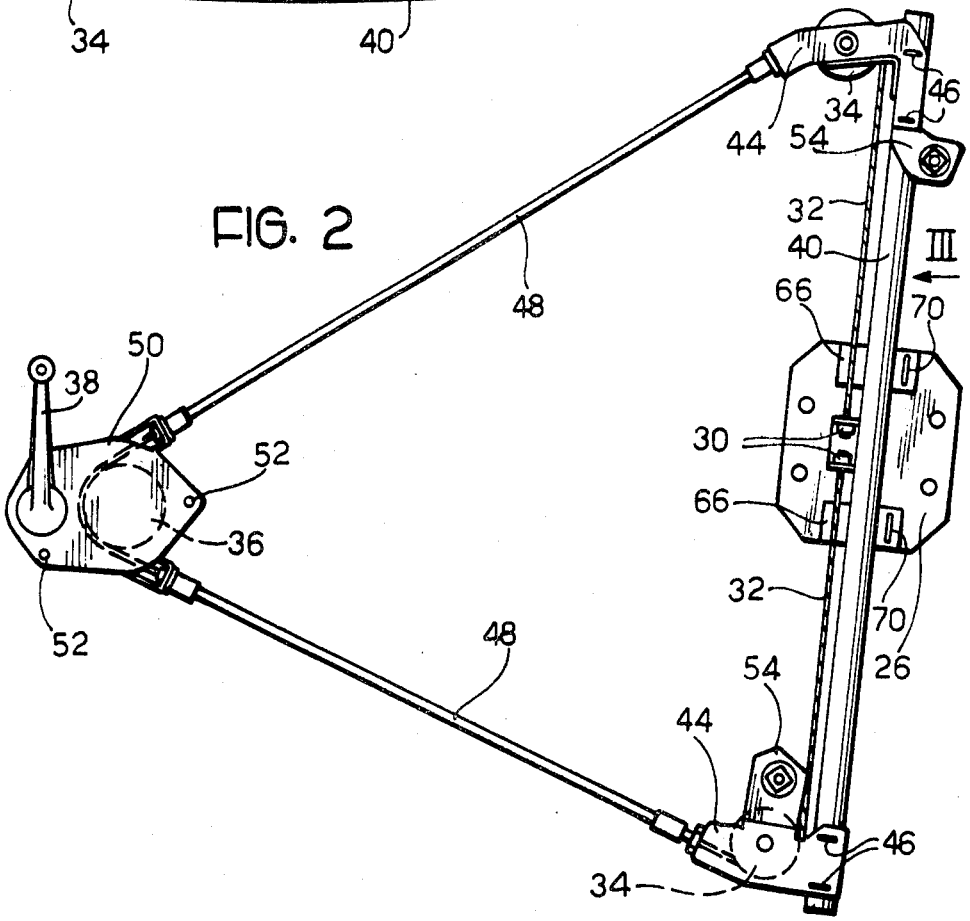

GUIDE DEVICE FOR A SLIDABLE WINDOW OF A VEHICLE

The present invention relates to a guide device for a slidable window of a vehicle, of the type comprising a central guide track extending in the direction of movement of the window and at least one slidable element movable along the guide track to guide a support member attached to the window parallel to the direction of movement of the window, the support member being connected to an element for transmitting movement to the support member from a winding device such as a handle.

The device of the aforesaid type is described in German Patent Specification No. 1,555,632.

The slidable elements connected to the guide track serve to guide the window in all positions in such a way that the window is prevented from rotating about a horizontal axis perpendicular to the surface of the window, thereby avoiding jamming of the window during opening and closing movement. This is particularly important for windows having non-parallel side edges which converge upwards, since during opening movement of such windows at least one of the side edges comes out of engagement with a respective guide groove provided in a door or in the body of the vehicle.

In known guide devices the slidable elements have two parallel guide surfaces which face towards each other and embrace a wing of the guide track; the wing extends in a direction perpendicular to the window and the distance between the guide surfaces corresponds at least approximately to the thickness of the wing.

Such known constructions are only able to prevent rotation or inclination of the window about an axis perpendicular to the surface of the window itself. In order to ensure that the window does not rotate about a substantially horizontal axis parallel to the window itself, and/or about an axis parallel to the direction of movement of the window, supplementary devices have to be employed. Such supplementary devices commonly consist of a second wing on the guide track parallel to the surface of the window, which is enclosed by parallel guide surfaces of supplementary slidable elements.

An object of the present invention is to provide a guide device of the type described above which avoids, by means of the slidable element itself, rotation or inclination of the window both about a horizontal axis, and about an axis parallel to the surface of the window.

According to the present invention there is provided a guide device of the type referred to, characterised in that the guide bar is tubular and has a longitudinal slot, and in that each slidable element comprises an insert of substantially cylindrical shape which is fixed to a wing protruding through the longitudinal slot, the said wing being part of an attachment element which is connected to the window support member.

The guide device of the invention has the advantage that the slidable insert is adapted to the internal profile of the tubular guide track and prevents the window from rotating about axes which are perpendicular to the longitudinal axis of the guide track, the slidable insert being effectively trapped in the tubular guide track.

Preferably each slidable insert comprises a sleeve, of a material having a low friction coefficient relative to the tubular guide track, which embraces the end of the wing contained within the tubular guide track, said sleeve having a slot for the passage of the said wing.

In the manufacture of the device according to the invention strict tolerances are not necessary in the dimensions of the guide track and the slidable inserts: the sleeve forming each slidable insert, preferably of plastics material, and the guide track provided with the slot, do not need to engage each other with a close fit. On the contrary, a certain play between the sleeves and the guide track assists in ensuring smooth sliding movement. The sleeve being of low friction coefficient material also ensures smooth sliding movement, and may enable lubricants to be dispensed with.

In a preferred embodiment of the invention the attachment element is made in a single piece, in which the wing which passes through the longitudinal slot of the tubular guide track is formed by a part of the said plate folded upon itself. Preferably, the end of the wing contained in the tubular guide track has a substantially cylindrical shape. This enables the device to be manufactured simply and at low cost. The wing of the folded plate forming the attachment element is reinforced, being of double thickness, while secure coupling of the sleeve on the wing of the attachment element is also ensured.

Preferably the longitudinal slot of the guide track faces towards the window and the attachment element has a substantially T-shaped transverse section.

The invention will be further described, by way of non-limiting example, with reference to the accompanying drawings, in which:

FIG. 1 is a plan view of the inside of a door of a motor vehicle from which an interior covering panel has been removed to show a guide device according to one embodiment of the invention for guiding a cable-operated window;

FIG. 2 is a view of the guide device shown in FIG. 1, on an enlarged scale;

FIG. 3 is a view of the guide track forming part of the guide device, taken in the direction of the arrow III of FIG. 2;

Figure 4:
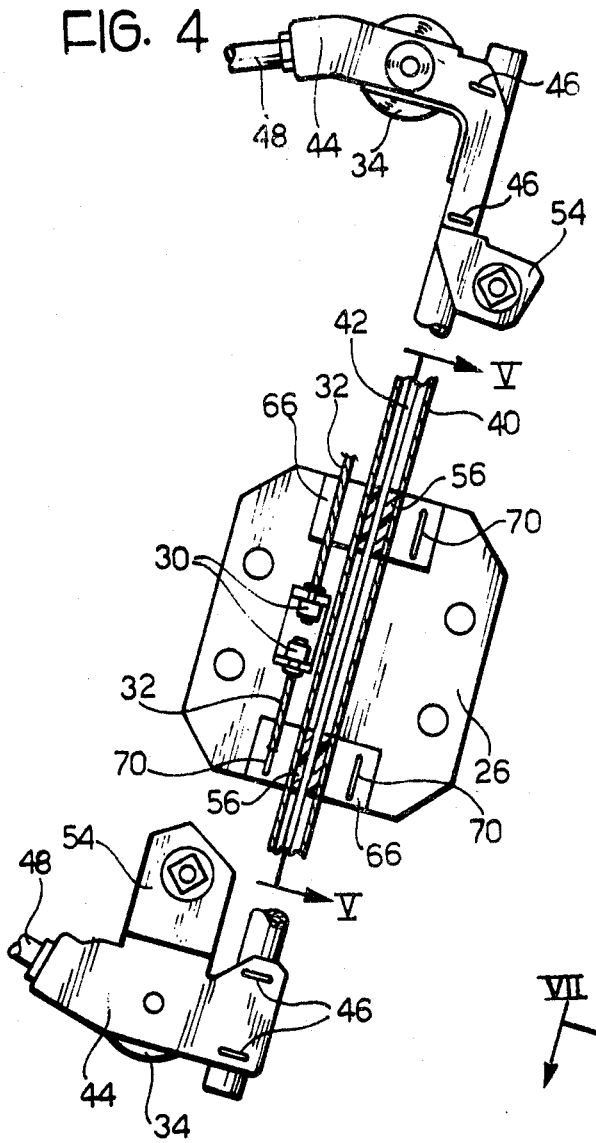
FIG. 4 is a partial view of FIG. 2, on an enlarged scale.
Figure 5:
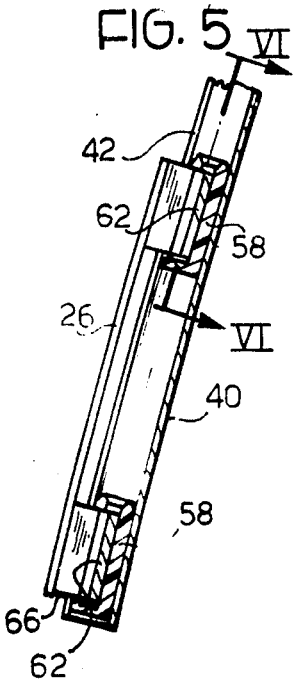
FIG. 5 is a sectional view taken on line V—V of FIG. 4.

Referring to the drawings, FIG. 1 illustrates schematically a door 10 of a motor vehicle, having a lower part into which a window 12 can be retracted by operation of a winding mechanism. The side edges 14 and 16 of the window 12 converge upwards, the right-hand side edge 16, as viewed in FIG. 1, extending vertically. During opening, that is, lowering movement, of the window, the left-hand side edge 14 of the window 12 is guided in a guide channel 18 extending in the substantially vertical direction of movement of the window 12, the edge 14 remaining in the guide channel 18 until the window 12 reaches the completely lowered position. The right-hand side edge 16 of the window 12 during this lowering movement comes out of the groove of a vertical support channel 20 as soon as the window is slightly opened, as shown in FIG. 1, so that, upon further lowering of the window 12, only the lower right-hand corner 22 of the window 12 runs in a guide channel 24 which forms a lower extension of the vertical support channel 20 and which extends parallel to the guide channel 18.

In the embodiment illustrated in FIG. 1, opening and closing of the window is effected by an operating cable controlled by a window-winding mechanism. The window-winding mechanism comprises a traction plate 26 to which is fixed a support member 28 attached to the lower edge of the window 12. The two ends 30 of an operating cable 32 are attached to the traction plate 26. The cable 32 is guided over two freely rotatable pulleys 34 rotatably mounted in the door 10. The cable 32 also passes over a control pulley 36 which is rotatable in a window raising or lowering direction by means of a rotatable control handle 38. Upon rotation of the handle 38, the traction plate 26 is made to go up or down according to the direction of rotation of the handle 38, causing the window 12 to be closed or opened respectively.

The window 12 is guided in its movement by a guide track 40 which extends parallel to the two guide channels 18 and 24 and which is fixed to the door 10 roughly centrally between the two channels 18 and 24 extending parallel to the latter.

From FIGS. 2 to 7 it is clear that the guide track 40 is tubular, its wall having a longitudinal through slot 42. At its upper and lower ends the guide track 40 carries respective brackets 44 attached, for example, by welds 46. Each bracket 44 supports the shafts of the respective pulleys 34. The brackets 44 are connected through relatively rigid and elastic sheaths 48 to a control box 50 which contains the control pulley 36 and the pivot shaft of the control handle 38. The operating cable 32 runs in the sheaths 48.

The guide track 40 and the control box 50 connected to it constitute a single unit ready for mounting on the door 10 by means of threaded legs 52 on the control box 50 and by means of screws passing through lugs 54 which are part of the brackets 44.

Figure 7:
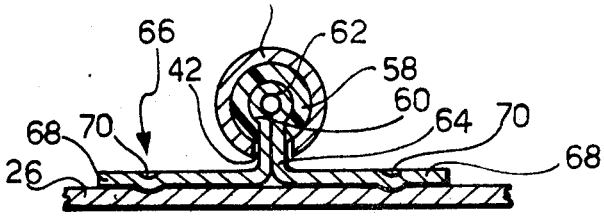
FIG. 7 is a cross section taken on line VII—VII of FIG. 6.

Within the tubular guide track 40 two spaced-apart sliding inserts 56 are located for the purpose of guiding the traction plate 26 and therefore the window 12. Each sliding insert 56 comprises a cylindrical sleeve 58, preferably of self-lubricating plastics material. The sleeves 58 are slidable relative to the internal surface of the tubular guide track 40. As shown in FIG. 7 each sleeve 58 has a slot 60 in register with the longitudinal slot 42 facing towards the window 12. An enlarged end 62 of an attachment element 66 is located within each sleeve 58, the attachment element 66 having a wing 64 which passes through the slots 60 and 42. The attachment element 66 is formed by a single piece of bent metal plate, the wing 64 being formed by a central portion of the plate folded on itself and the enlarged end 62 being formed at the apex of the central portion with a cylindrical shape. The sleeve 58 thus embraces the cylindrical end 62 of the wing 64 and is tightly secured thereto so that the sleeve 58 is captive on the wing 64.

The attachment element 66 has a T-shaped transverse section, as shown in FIG. 7, the cross-piece of which is formed by flanges 68, external to the tubular sleeve 58, each of which is provided with an indentation forming a stud 70 by means of which the attachment element 66 is secured to the traction plate 26, for example by welding.

Figure 6:
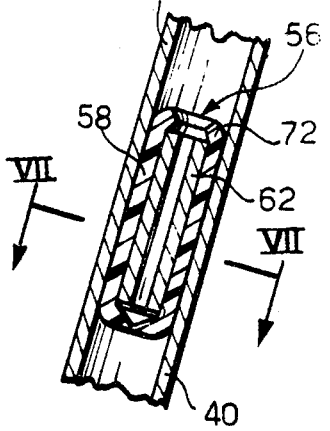
FIG. 6 is a partial section on line VI—VI of FIG. 4, on an enlarged scale.

As shown in FIG. 6 each sleeve 58 is closed at one end by a bottom end wall, the other (upper) end of the sleeve 58 being open and bounded by an inwardly projecting lip 72 formed by deformation under heat. In this way each sleeve 58 is prevented from sliding with respect to the attachment element 66 in the direction of movement of the latter.

The traction plate 26, and therefore the window support member 28 fixed to the lower edge of the window 12, is guided in a direction parallel to the direction of movement of the window 12 by the sliding inserts 56 formed by the sleeves 58 which slide within the tubular guide track 40. In this way the window 12 is prevented from rotating both about an axis perpendicular to the surface of the window 12 and about axes parallel to the window surface.

In an alternative to the embodiment illustrated and described, the sleeves 58 may be replaced by other forms of slidable insert 56. Thus the slidable insert 56 could be filled with lubricant assisting the sliding of the insert 56 in the tubular guide track 40. The lubricant could be supplied from the insert 56 through side perforations. Although in the preferred embodiment herein described the longitudinal slot 42 of the guide track 40 is turned towards the window 12, the longitudinal slot 42 could alternatively be disposed in a laterally facing surface of the tubular guide track 40: in this case the shape of attachment element 66 would be modified correspondingly.

A guide device according to the invention can be used for different types of window winders, worked by hand or motor-driven, other than the cable-operated window winder herein described.

It will be appreciated that manufacturing details of practical embodiments of the invention may be varied widely with respect to the embodiment illustrated and described by way of example, without departing from the scope of this invention.

I claim:

1. A guide device for a slidable window of a vehicle, comprising:

a support member for attachment to a lower edge of the window;

a central guide track extending in the direction of movement of the window, said guide track being tubular and having therein a longitudinal slot, said guide track having means for its attachment to a vehicle door;

a pair of spaced-apart slidable elements having a substantially cylindrical shape and each of which is slidably fitted in said tubular guide;

a pair of spaced-apart attachment elements connected to the window support member, each of said attachment members having a wing protruding through said longitudinal slot and attached to one of said slidable elements;

transmission means for transmitting movement to the support member from a window winding device such as a handle, said transmission means comprising a flexible looped cable having two adjacent ends which are both connected to said support member;

first and second bracket means each attached to one of the ends of said tubular guide; and a first pulley rotatably mounted on said first bracket means and a second pulley rotatably mounted on said second bracket means, said looped cable being trained tover said pulleys and the latter defining between them a cable path which extends alongside said tubular guide and which includes said cable ends.

2. A guide device as set forth in claim 1 wherein each of said slidable elements is of a material having a low friction co-efficient relative to said tubular guide and is provided with a longitudinal slot for the reception of said wing.

3. A guide device as set forth in claim 1, wherein each attachment element is comprised of a T-shaped plate, the protruding wing of which is provided by a double thickness fold in said plate.

4. A guide device as set forth in claim 3, wherein the end of the wing disposed in tubular guide track has a cylindrical configuration which is disposed within the cylindrical slidable element.

* * * * *